United States Patent [19]

Beeler et al.

[11] 4,040,177

[45] Aug. 9, 1977

[54] METHOD OF MANUFACTURING AN ELECTRICAL CONTACT

[75] Inventors: Alfred Beeler, Horgen, Switzerland; Wilhelmus Marinus Cornelius van der Mijden, Eindhoven, Netherlands

[73] Assignee: U.S. Philips Corporation, New York, N.Y.

[21] Appl. No.: 689,946

[22] Filed: May 25, 1976

Related U.S. Application Data

[62] Division of Ser. No. 553,532, Feb. 27, 1975, abandoned.

[51] Int. Cl.[2] ..... H01R 9/04

[52] U.S. Cl. ..... 29/630 C; 72/324; 72/326; 81/9.51

[58] Field of Search ..... 29/629, 630 R, 630 C; 113/119; 140/123, 123.5, 123.6; 81/9.51; 72/324, 326, 332

[56] References Cited

U.S. PATENT DOCUMENTS

| | | | |
|---|---|---|---|
| 376,914 | 1/1888 | Russell | 72/325 X |
| 501,851 | 7/1893 | Stupakoff | 72/326 |
| 901,667 | 10/1908 | Wrigley | 72/326 |
| 1,538,628 | 5/1925 | Dincognito | 81/9.51 |
| 1,925,721 | 9/1933 | Johnston | 72/325 |
| 2,697,821 | 12/1954 | Utz | 339/258 R |
| 3,286,220 | 11/1966 | Marley et al. | 339/258 P |
| 3,751,960 | 8/1973 | Morton et al. | 72/326 |
| 3,812,452 | 5/1974 | Strum | 339/258 R |
| 3,857,142 | 12/1974 | Hills | 72/324 X |

*Primary Examiner*—Victor A. DiPalma
*Attorney, Agent, or Firm*—Frank R. Trifari; Rolf E. Schneider

[57] ABSTRACT

A method of manufacturing an electrical contact member by splitting an end portion of a bar longitudinally into two parts, flattening and bending the two parts thus obtained.

5 Claims, 17 Drawing Figures

METHOD OF MANUFACTURING AN ELECTRICAL CONTACT

This is a division of application Ser. No. 553,532, filed Feb. 27, 1975, now abandoned.

BACKGROUND OF THE INVENTION

1. Field of the Invention

This invention relates to an electrical contact member, notably for a multiple socket connector, which is made of one piece of electrically conductive material and which consists of a comparatively rigid shaft on one end of which two comparatively flexibly resilient tongues extend approximately parallel to the longitudinal dimension of the shaft, at least one of the said tongues being provided with a contact area near its free end, and also relates to a method of manufacturing such a contact member.

2. Description of the Prior Art

It is known to manufacture electrical contact members for, for example, multiple socket connectors, from a suitably shaped piece of sheet material by one or more bending operations (see for example British Pat. No. 836,397). The sheet material can be obtained from a larger sheet by stamping. Generally, comparatively high material losses occur, which adversely affects the price of the product.

SUMMARY OF THE INVENTION

The invention has for its object to provide a contact member which can be manufactured substantially without loss of material. To this end, according to the invention a contact member consists of a bar, one end portion of which is split into two parts in its longitudinal dimension, thus forming the tongues, the non-split portion forming the shaft.

The wide sides of the two tongues are preferably directly opposite each other, thus facilitating contact with a plug connector. The resilient properties of the tongues are enhanced if the thickness of each of the tongues is less than half the thickness of the shaft.

In a method of manufacturing a contact member according to the invention a bar, having a cross-section which is substantially equal to that of the shaft of the contact member to be formed, is split into two parts over a part of its length after which the tongues are formed by plastic deformation from the parts separated from each other by splitting.

The splitting can be effected in various ways, for example, by enclosing the portion of the bar to be split between two tools, each tool enclosing substantially half the circumference of the bar. The tools are then moved, sliding along each other perpendicular to the longitudinal dimension of the bar in mutually opposed directions, over a distance which is sufficient to produce the desired splitting. In another method of splitting the bar to be split is retained over a part of its length such that one end is free, after which a wedge is longitudinally driven into the bar through this end.

The plastic deformation after the splitting preferably consists of at least a flattening operation and a bending operation. After the flattening, the tongues can be provided, if desired, with a desired profile by stamping. The latter operation is the only one in which loss of material can occur; however, this loss is much smaller than the loss of material occurring in the methods heretofore used. No loss of material whatsoever occurs during the splitting and deformation.

The invention will be described in detail hereinafter with reference to the accompanying drawings, in which:

DESCRIPTION OF THE PREFERRED EMBODIMENTS

Figure 1:
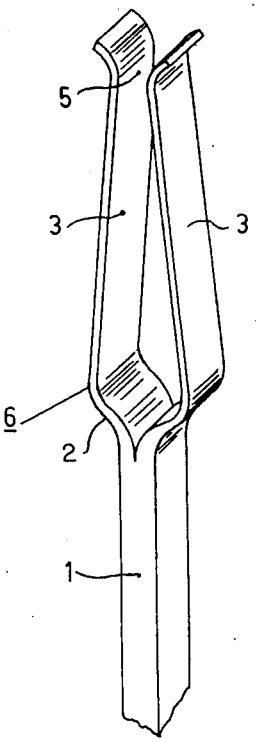
FIG. 1 is a perspective view of a contact member according to the invention.

The contact member shown in FIG. 1 consists of a comparatively rigid shaft 1, on one end of which (the upper end in FIG. 1) two comparatively flexibly resilient tongues 3 are situated which extend parallel to the longitudinal dimension of the shaft. A number of such contact members are usually arranged in an insulating housing (not shown) so as to form a multiple socket connector, the shafts 1 partly projecting outside the housing. While the housing comprises further openings through which plug contact members can make contact with contact areas 5 situated near the free ends of each of the tongues 3. The shafts 1 are connected to connection wires, preferably by wire wrapping, for which purpose special requirements are imposed as regards the shape of the shaft. These requirements are: the cross-section of the shaft should be square and have a side of between 0.5 and 2 mm, preferably 0.6 or 1 mm. If desired, the shape of the shaft particularly the end removed from the portion adjacent the tongues can also be adapted to other methods of connecting connection wires, for example, soldering. The tongues 3 are situated with respect to each other such that the wide sides comprising the contact areas 5 are arranged opposite each other, so that a plug contact member co-operating with the contact member contacts a tongue at two diametrically arranged locations.

The tongues 3 are formed from the split end of a bar 6, the non-split portion of which constitutes the shaft 1. After that, the shape shown in FIG. 1 is imparted by bending the tongues at their shaft ends 2, and by flattening and bending to form the main portion of the tongues 3 and the contact areas 5. In order to improve the resilient properties of the tongues 3, their thickness has been reduced during these operations, with the result that their thickness is less than half the shaft thickness at the region adjacent the tongue ends 2.

Figure 4:
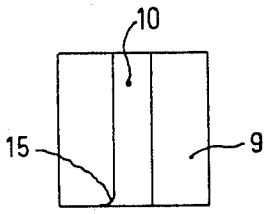
FIG. 4 is a side elevation viewed in the direction of the arrows IV—IV of FIG. 2 of one of the tools shown in FIG. 2.

The splitting of the bar 6 can be effected in various manner. According to a first method (see FIGS. 2 and 3) the portion 7 of the bar 6 to be split is enclosed by two tools 9 and 11, each of which encloses substantially half the circumference of the bar. The tools 9 and 11 are provided with grooves 10 and 12, respectively, which when the tools are arranged against each other as shown, form a duct in which the bar fits exactly. Subsequently, the tools 9 and 11 are moved perpendicular to the longitudinal dimension of the rod 6 in mutually opposed directions while sliding along each other; this is denoted in FIG. 2 by arrows. The portion 7 of the bar 6 is then split along the broken line 13 shown in FIG. 3 by the shearing action. The distance over which the tools 9 and 11 are moved should be just large enough to ensure splitting along the entire broken line 13, but should not be so large that the tongues 3 formed break off at the shaft end area where they meet. In order to minimize this risk of breaking, the grooves 10 and 12 preferably have a rounded corner 15 on their lower side as shown in FIG. 4 for the groove 10. After the splitting, the tools 9 and 11 are returned, if desired, to the position shown in FIG. 2, so that the tongues 3 formed are situated directly opposite each other.

A second method of splitting the bar 6 will be described with reference to FIG. 5. The bar 6 is retained over a portion of its length in a block 17 which is provided with a duct 19 in which the bar fits such that it can slide longitudinally. The free end of the portion 7 of the bar 6 to be split projects above the block 17. Opposite this free end there is provided a wedge 21 which is connected to the block 17. When the assembly formed by the block 17 and the wedge is moved in the direction of the arrow, for example, by a press (not shown) the wedge is driven into the free end of the bar 6, with the result that this end is split. As the wedge 21 penetrates further into the portion 7 to be split, the block 17 also moves downward further, so that the tongues formed can deflect laterally in front of the wedge 21. The portion 7 is thus split along the entire broken line 13. In the example shown in FIG. 5, the lower end of the bar 6 bears on a table 23. This can be readily done if the bar 6 is strong enough, so as not to be deformed by the force exerted on the wedge 21. If this is not so, the bar 6 can bear, for example, on a pin (not shown), the height of the block 17 then being such that it encloses the entire bar plus a part of the pin in its upper position. The bar 6 is then protected against deformation over its entire length.

Figure 5:
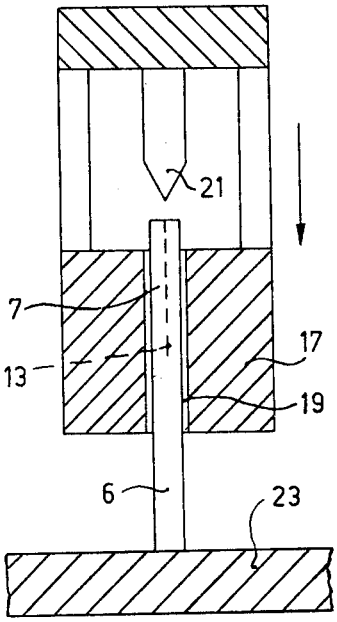
FIG. 5 is a cross-sectional view of a tool for performing a second embodiment of the method according to the invention, FIGS. 6 (*a* and *b*) to 10 (*a* and *b*) show a number of stages in the manufacture of a contact member according to the invention, and FIGS. 11 (*a* and *b* show further embodiments of the contact member.
Figure 6A:
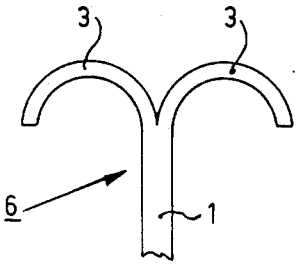
Figure 6B:
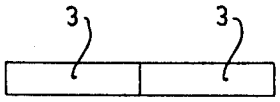

After the splitting by means of the tool shown in FIG. 5, the bar 6 is shaped as shown in side elevation in FIG. 6*a* and in plan view in FIG. 6*b*, the tongues 3 then being curled outwards. In order to impart the desired shape to these tongues, a number of operations are required which successively produce the intermediate products shown in FIGS. 7, 8 and 9, each time in side elevation as well as in plan view. The tools used for these operations are generally known and will not be described herein.

Figure 7A:
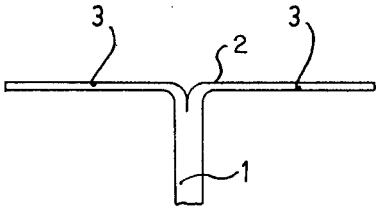
Figure 7B:
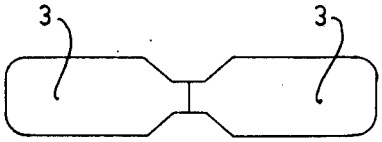
Figure 8A:
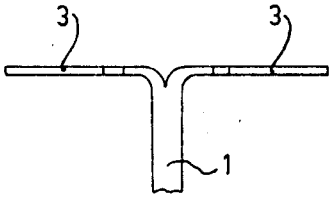
Figure 9A:
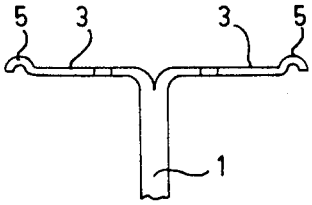
Figure 8B:
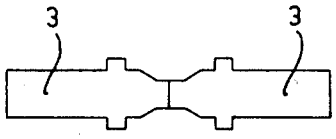
Figure 9B:
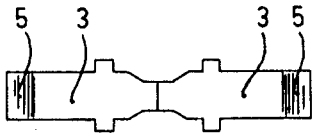

First of all, the tongues 3 are flattened so that they obtain the shape shown in FIGS. 7*a* and *b*. Subsequently, they are subjected, if desired, to a stamping operation so as to impart a desired profile thereto (FIGS. 8*a* and *b*). The next step is a bending operation during which the contact areas 5 are formed (see FIGS. 9*a* and *b*). If desired, these contact areas can be covered with a suitable metal such as gold in an electrolytic manner. Finally, the tongues 3 are folded towards each other so that the contact member shown in FIG. 1 is obtained. This folding operation can possibly be combined with the said bending operation.

Figure 2:
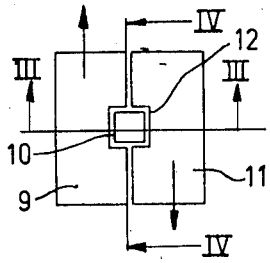
FIG. 2 is a plan view of a set of tools for performing a first embodiment of a method according to the invention.
Figure 3:
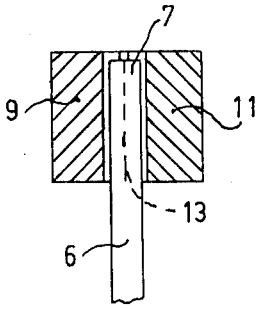
FIG. 3 is a cross-sectional view taken along the line III—III of FIG. 2 of the tools shown in FIG. 2.
Figure 10A:
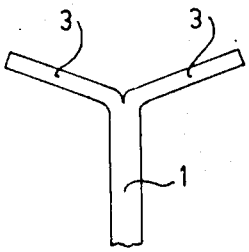
Figure 10B:
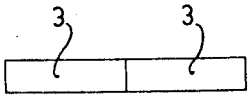

If the bar has been split according to the method described with reference to FIGS. 2 to 4, it does not have the shape shown in FIG. 6. The portion 7 has then retained its orginal shape, having been split in its longitudinal dimension according to the broken line. Before the tongues 3 are flattened, they are first bent apart, an intermediate product shaped as shown in FIG. 10*a* in side elevation and in FIG. 10*b* in plan view then being produced. Subsequently, the operations described with reference to FIGS. 7 to 9 can be performed.

Figure 11A:
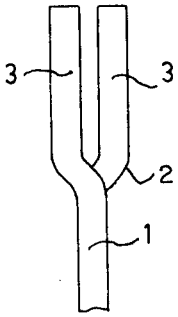
Figure 11B:
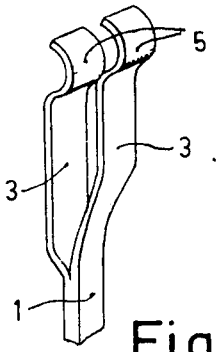

In another emobodiment the tongues are not bent apart as shown in FIG. 10, but are slid adjacent each other, as shown in side elevation in FIG. 11*a* , so that after the flattening and bending a contact spring is obtained having two tongues 3 which are adjacently situated in approximately one plane. The contact areas 5 are then also adjacently situated instead of opposite each other. This is shown in perspective in FIG. 11*b*.

What is claimed is:

1. A method of manufacturing an electrical contact member from a bar of electrically conductive material, which comprises splitting the bar longitudinally over a portion of its length from one end into two parts, and plastically deforming the two parts to form contact tongues by bending such parts so that they diverge in opposite directions from the longitudinal dimension of the bar, flattening each part to provide respective flat surfaces, and bending such flattened parts so that they extend in spaced relation to each other approximately parallel to the longitudinal dimension of the bar with such flat surfaces oppositely disposed.

2. A method as claimed in claim 1, which includes profile stamping the flattened parts.

3. A method as claimed in claim 1, in which the end portion of the bar is enclosed by two longitudinally extending tools, each tool extending around a portion of the circumference of the bar, and relative motion between the tools is effected in mutually opposed directions perpendicular to the longitudinal dimension of the bar so as to split the bar by shearing.

4. A method as claimed in claim 1, in which the end portion of the bar is enclosed in a duct so arranged that such end of the bar projects from the duct, and a wedge is driven longitudinally into such end of the bar to effect splitting of the same.

5. A method as claimed in claim 4, in which relative motion between the bar and the duct is effected so that the split parts can deflect laterally in front of the wedge.

* * * * *

UNITED STATES PATENT AND TRADEMARK OFFICE

CERTIFICATE OF CORRECTION

PATENT NO. : 4040177

DATED : August 9, 1977

INVENTOR(S) : ALFRED BEELER ET AL

It is certified that error appears in the above-identified patent and that said Letters Patent are hereby corrected as shown below:

On the title page, insert section [30] where appropriate

--[30] FOREIGN APPLICATION PRIORITY DATA
March 1, 1974 Netherlands.....7402780--

Column 1, line 24, "836,397" should be --826,397--

Column 2, line 35, "housing. While" should be --housing, while--

Column 2, line 64, "manner" should be --manners--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*